US006991407B2

(12) United States Patent
Dannehl et al.

(10) Patent No.: US 6,991,407 B2
(45) Date of Patent: Jan. 31, 2006

(54) LIFT CYLINDER ASSEMBLY

(75) Inventors: Friedrich Wilhelm Dannehl, Hagen (DE); Werner Reinelt, Bochum (DE); Holger Behnert, Wuppertal (DE)

(73) Assignee: DBT GmbH, Lunen (DE)

( * ) Notice: Subject to any disclaimer, the term of this patent is extended or adjusted under 35 U.S.C. 154(b) by 0 days.

(21) Appl. No.: 10/844,694

(22) Filed: May 13, 2004

(65) Prior Publication Data

US 2004/0244999 A1 Dec. 9, 2004

(30) Foreign Application Priority Data

May 19, 2003 (DE) ..... 203 07 907 U

(51) Int. Cl.
*E21D 23/08* (2006.01)

(52) U.S. Cl. ..... 405/290; 405/299

(58) Field of Classification Search ..... 403/361, 403/300, 306, 235; 405/290–301
See application file for complete search history.

(56) References Cited

U.S. PATENT DOCUMENTS 3,397,012 A * 8/1968 Krekeler ..... 299/104
3,767,234 A * 10/1973 Weirich et al. ..... 285/123.2
5,039,257 A 8/1991 Bithell
5,961,254 A 10/1999 Friedrichs

FOREIGN PATENT DOCUMENTS

| | | |
|---|---|---|
| DE | 4214690 | 11/1993 |
| DE | 19633847 | 5/1999 |
| GB | 1104428 | 2/1968 |

* cited by examiner

*Primary Examiner*—John Kreck
(74) *Attorney, Agent, or Firm*—Fay, Sharpe, Fagan, Minnich & McKee, LLP

(57) ABSTRACT

A lift cylinder arrangement is disclosed for a hydraulic support frame for underground mining. The support frame has a lift cylinder for lifting the base shoes during advancing, which is supported on the one hand on a return rod and on the other hand, in a pivoting manner, with an end supporting head to a drawbar connected to the base shoes. In order to allow a simple, rapid and reliable connection between the supporting head and the drawbar, the supporting head is connected to the drawbar by a plug-type locking system comprising two plug-type locking elements, which include first locking notches on the drawbar, and arranged complementarily thereto second locking notches on the supporting head, whereby the plug-type locking elements engage in at least one of the locking notches with clearance.

19 Claims, 3 Drawing Sheets

1
2
3
4
5
6
7
8
9
10

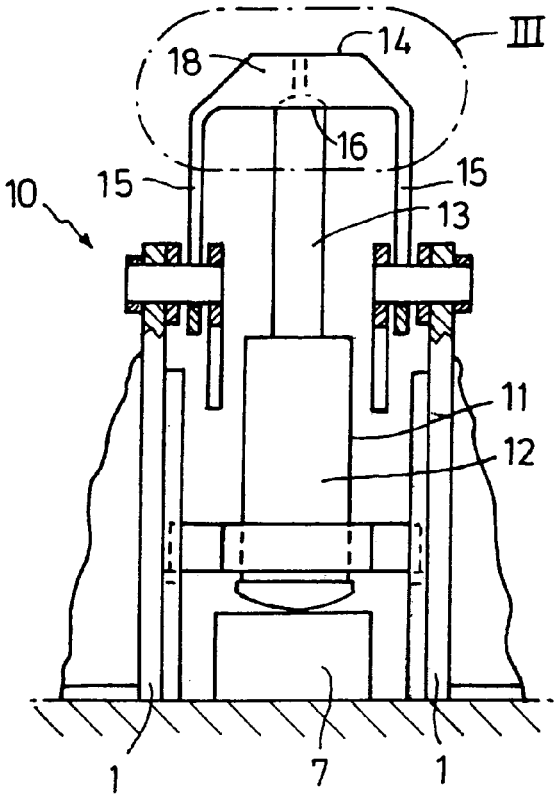
Fig.2
Fig.3
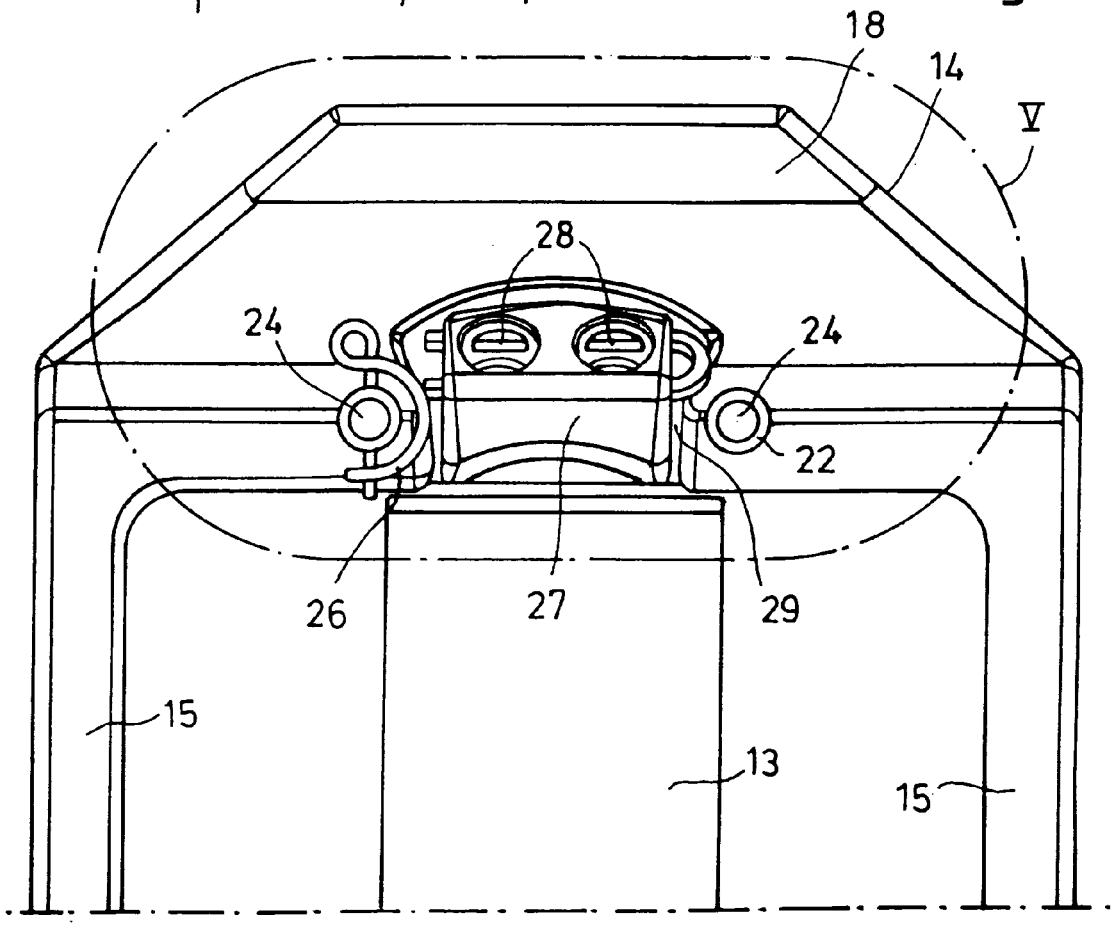

LIFT CYLINDER ASSEMBLY

FIELD OF THE INVENTION

The present invention relates to a lift cylinder assembly for a hydraulic support frame for underground mining. The assembly comprises a lift cylinder, arranged essentially upright relative to base shoes of the support frame, for lifting the base shoes during advancing of the support shield. The lift cylinder is supported on one side by a return rod extending between the support frame and a face conveyor and on the other side by a drawbar which is connected to the base shoes. The lift cylinder is attached to the drawbar in a limited pivoting manner by an end support head. The drawbar is preferably, but not necessarily, approximately U-shaped.

BACKGROUND OF THE INVENTION

A lift cylinder arrangement of this type is known from DE 196 33 847 C1. It is used to lift the base shoes of an advancing support frame at their forward ends from the floor so that the base shoes do not hit steps in the floor or sink into the floor while being advanced.

In the known arrangement, the lift cylinder is attached to the drawbar by use of a fastening screw inserted from above through the horizontal arm of the drawbar and screwed into the support head coaxially to the cylinder axis. In order to achieve the required articulation, so that the connection between the drawbar and lift cylinder can match each removal, advancing and setting procedure, and the constantly changing geometrical conditions due the uneven floor; the hole for the screw in the horizontal arm of the drawbar is larger in diameter than the screw and the latter is convex on the lower side of the screw head while the horizontal arm of the drawbar is correspondingly concave on its upper side. The manufacturing costs of this attachment are very high. This attachment also has the disadvantage that the cross-section of the drawbar with the hole for the screw and the concave recess is constricted at a decisive point which weakens the drawbar, thus making it necessary to provide the drawbar with greater material strength. The alternating stresses acting on the components quickly result in a widening of the hole in the support head of the cylinder thereby resulting in destruction of the screw connection due to corrosion and/or dirt penetration.

SUMMARY OF THE INVENTION

The aim of the present invention is to eliminate these drawbacks and to provide a connection between the support head and the drawbar which is easy and inexpensive to manufacture, can be quickly and simply assembled and dismantled and is not, or at least only slightly, susceptible to damage due to corrosion and/or dirt penetration.

Accordingly, the present invention provides that the support head is connected to the drawbar by use of a plug-type locking system which has two plug-type lock elements. These elements include first locking notches on the drawbar essentially arranged laterally to the longitudinal axis of the lift cylinder, and, arranged essentially complementarily thereto, second locking grooves on the support head. The plug-type locking elements engage in the first locking notches and/or the second locking notches with a clearance. In an advantageous embodiment of the invention, the arrangement can be such that the plug-type locking elements are formed by the arms of an approximately U-shaped locking clamp.

The above arrangement has the advantage that the hole in the drawbar and the threaded drilled hole in the supporting head of the lift cylinder can be dispensed with so that no material reinforcement in the horizontal arm of the drawbar is necessary and water or dirt cannot enter from above through the hole and reach the bearing position between the drawbar and supporting head. The plug-type locking elements are simply inserted from the side in such a way that they simultaneously engage with the first and second locking notches so that both components are secured by each other. The required clearance is thus achieved in that the plug-type locking elements engage with at least the first or the second locking notches with play so that they can move slightly up and down relative to these notches.

The drawbar preferably has a recess which is open at the bottom and concave and which becomes an approximately cylindrical wall section. The arrangement is such that the first locking notches are arranged in the area of the cylindrical wall section. The supporting head preferably has an upper surface which corresponds to the shape of the concave recess. The supporting head expediently transitions into an approximately cylindrical section in which the second locking notches are arranged. The cylindrical wall section and the corresponding cylindrical section of the support head, which is slightly smaller in diameter, ensure secure lateral stability of the lift cylinder in the drawbar.

The first locking notches and/or the second locking notches can be approximately semi-circular in cross section.

In order to provide the necessary clearance, the first and/or second locking notches are preferably larger in cross-section than the plug-type locking elements, a requirement which can be particularly easily taken into account in the design.

A particularly advantageous embodiment is achieved if the first locking notches are formed of transverse drilled holes passing through the drawbar and open laterally in the area of the recess or the cylindrical wall section.

The second locking notches can be arranged tangentially to the support head and arranged parallel to each other, thereby simultaneously forming an anti-torsion lock between the supporting head and drawbar and ensuring that the lift cylinder is always mounted in this way on the drawbar and that the hydraulic connections of the cylinder lying between the parallel locking notches are directly accessible.

Alternatively, it is also possible for the second locking notches to be formed by a ring groove surrounding the supporting head, which can easily be produced by lathe turning and is chosen in particular if the position of the supporting head relative to the drawbar does not matter, for example if the hydraulic connections of the cylinder are in the base area of the cylinder.

The drawbar can be provided with at least one recess between the two first locking notches which in terms of size and shape correspond to hydraulic connections provided on the lift cylinder or its supporting head.

So that the plug-type locking elements do not unintentionally fall out when the support frame is in operation, it is advantageous if, when inserted, the plug-type locking elements or the locking clamps forming these can be secured with spring clips or similar devices.

BRIEF DESCRIPTION OF THE DRAWINGS

Further features and advantages of the invention are set out in the following description and the drawings in which a preferred embodiment of the invention is explained and set out as an example.

FIG. 2 shows a front view of the lift cylinder arrangement;

FIG. 3 shows detail III of the lift cylinder arrangement in accordance with FIG. 2;

DETAILED DESCRIPTION OF THE PREFERRED EMBODIMENTS

Figure 1:
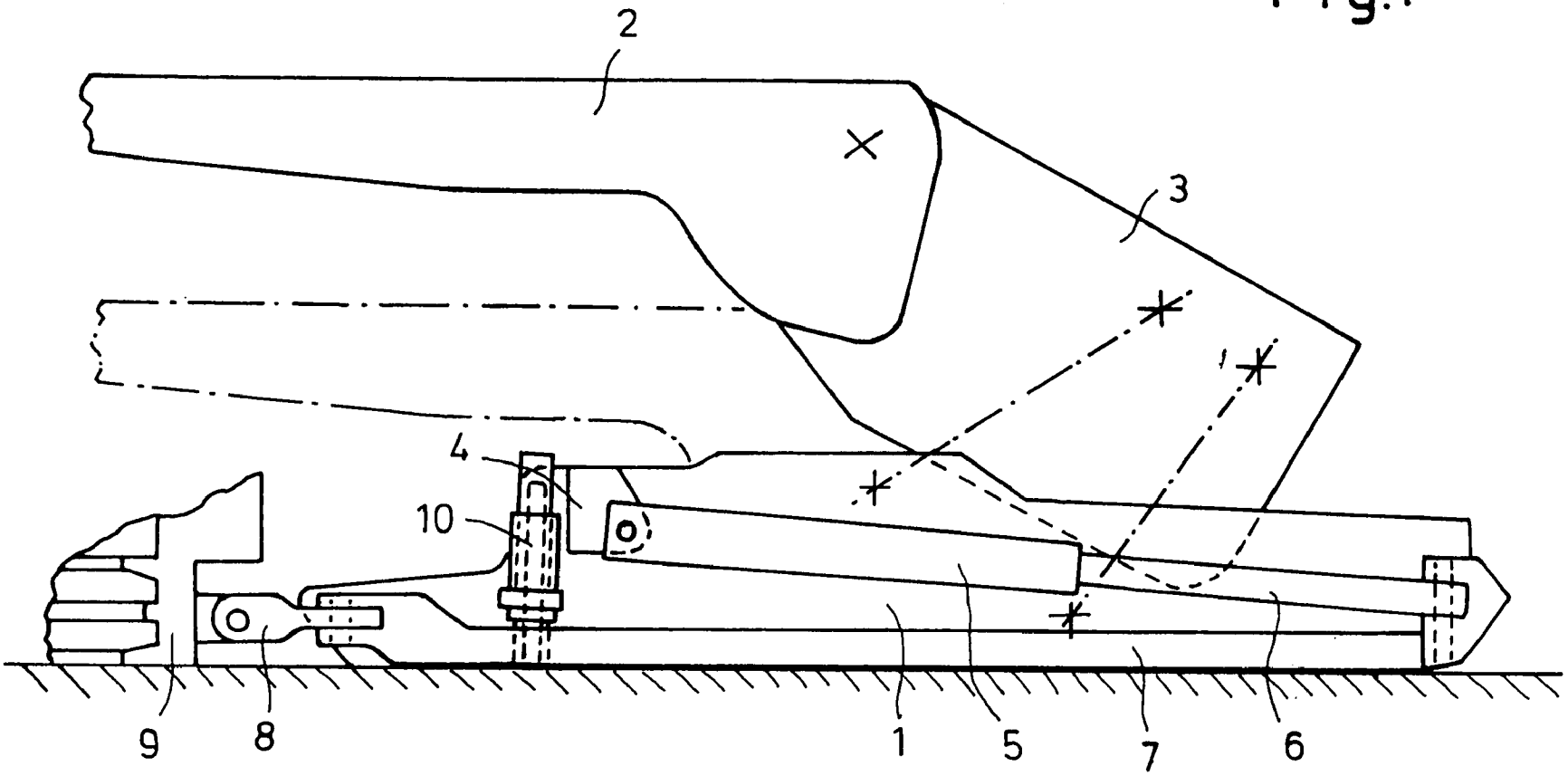
FIG. 1 shows a side view of an advancing support frame with a lift cylinder arrangement according to the invention.
Figure 4:
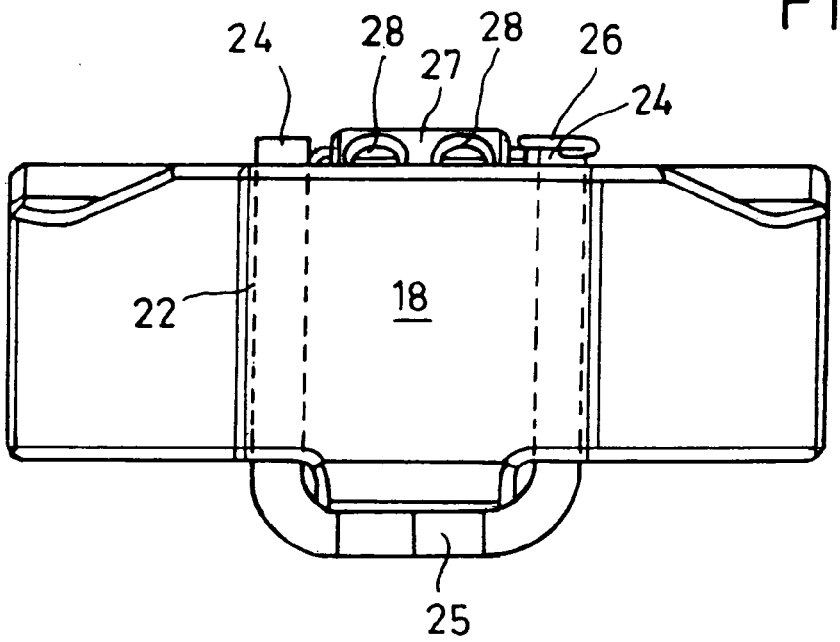
FIG. 4 shows a view from above of the component in FIG. 3.

The advancing support frame shown in FIG. 1 has two base shoes 1 arranged at a distance in parallel to each other, on which a height-adjustable stamp, which is not shown in the drawing, is arranged to support a roof cap 2. On the goaf side of the roof cap a breaking shield 3 is articulated which is arranged on the base shoes 1 and can be vertically pivoted by means of only indicated, unmarked rods of a four-link drive system.

On the working face side, the two base shoes 1 are connected to each other by use of a lateral beam 4 which forms an abutment for a pushing cylinder 5 which is connected in an articulated manner to the transverse beam and has piston rod 6 which extends towards the packing. At the goaf side end, the piston rod 6 is connected to a rod 7 arranged above the floor which is connected in an articulated manner via a coupling element 8 to a face conveyor 9 arranged along the working face.

The piston rod 6 of the pushing cylinder 5 is extended if the support frame is moved towards the conveyor 9 with its base shoe. During mining the conveyor 9 with the rod 7 is advanced further in the direction of the coal face by the retracting piston rod 6. Subsequent to mining the advancing support frame detached from the roof is again pulled by the extending piston 6 of the push cylinder 5 towards the conveyor 9 which forms the working face abutment for the advancing support frame.

The rod 7, connected in an articulated manner to the conveyor 9, is at the same level as the conveyor 9 and the base shoes 1 if the floor is level. However, during mining work differences in level can occur as the mining machine cuts higher or lower levels onto which the conveyor is pushed. The subsequent advancing procedure is mainly hindered by the base shoes 1 hitting a step in the floor or sinking into soft floor material. This can be rectified in a known manner by use of a lifting cylinder arrangement 10 with which the forward ends of the base shoes are lifted during or after the advancing procedure so that they are at the same level as the advanced conveyor. The particular configuration of the lift cylinder assembly forms the subject matter of the invention.

Figure 5:
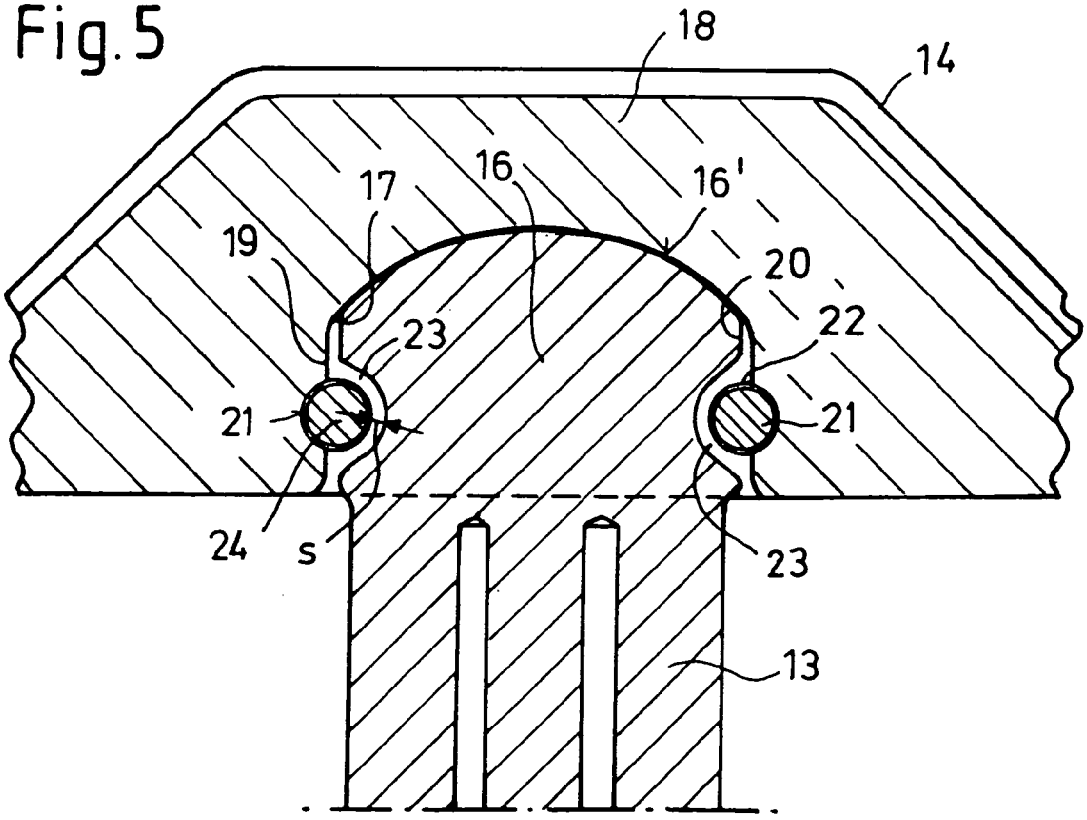
FIG. 5 shows a cross section of detail V in FIG. 3.

As can be seen from the drawings the lift cylinder arrangement comprises a lift cylinder 11, arranged in an upright position relative to the base shoes 1. The lift cylinder 11 is supported with its lower cylinder section 12 on the rod 7 and on the other side with its upper piston rod 13 on an approximately U-shaped drawbar 14. The drawbar 14 is attached by its two vertical arms 15 to the base shoes 1. The piston rod 13 is supported on the drawbar 14 by way of a supporting head 16 on the free end of the piston rod, which forms a convex support surface 16' and engages in a concave recess 17 in the horizontal arm 18 of the drawbar 14. The concave recess 17 is open toward the bottom and corresponds to the convex shape of the supporting head 16. FIG. 5 shows best that the concave recess 17 transitions into an approximately cylindrical wall section 19 and that the convex support surface 16' of the supporting head 16 becomes a cylindrical section 20 which engages in the cylindrical wall section 19 of the recess 17 with clearance.

Provided in the cylindrical wall section 19 are first locking notches 21 which are formed by one or more, e.g. two, transverse drilled apertures or holes 22 from the horizontal arm 18 of the drawbar 14, which intersect the recess 17 and are therefore open to the side in the area of the cylindrical wall section 19. Preferably, the one or more apertures extend at right angles with respect to the longitudinal axis of the rod 13. And, it is preferred that the aperture intersect the engagement interface resulting when the rod 13 or head 16 is engaged in the recessed region defined along the underside of the drawbar 18. On the cylindrical section 20 of the supporting head 16, at the same level or position as the first locking notches 21, second locking notches 23 are defined, i.e. to result in two second locking notches running in parallel to each other tangentially to the supporting head 16. Alternatively, the supporting head 16 could also be provided with a circumferential groove on its cylindrical section.

To attach the supporting head 16 to the drawbar 14, plug-type locking elements 24 are inserted from the outer lateral side of the drawbar into the two transverse drilled holes. The plug-type locking elements engage in the area of the intersection of the transverse drilled holes 22 with the cylindrical wall section 19, i.e. in the first locking notches 21 in the drawbar, and at the same time in the second locking notches 23 in the supporting head thereby interlocking the two components. The two plug-type locking elements 24 are formed of the two arms of an approximately U-shaped locking clamp 25, which are designed like the plug-type prongs used in underground mining for the positive fastening of hydraulic hoses to valve connections etc. So that they do not fall out during rough operation, the plug-type locking elements are secured with spring clips 26 or other retaining elements at their free ends which project from the other side of the drawbar.

The plug-type locking elements 24 of the locking clamp 25 are circular in cross-section, while the first and second locking notches 21 and 23 respectively are each semi-circular. This arrangement is such that although the first locking notches 21 of the transverse drilled holes in the drawbar correspond in their radius to the diameter of the plug-type locking elements 24, i.e. they are only larger to the extent that the locking elements 24 can be inserted into the transverse drilled holes without great force, the radius of the second locking notches 23 is noticeably larger so that there is sufficient clearances between the inserted locking elements 24 and the second locking notches 23, which clearance allows the drawbar to move approximately 5° essentially in all directions with regard to the attached rod head 16.

It can be seen that through the particular embodiment in accordance with the invention the drawbar is enclosed at its top, so that neither moisture nor dirt can enter the gap between the supporting head and the drawbar. The fastening is very robust and can be assembled and dismantled with the locking clamp in a very short time, whereby the use of spring clips prevents the unintentional loosening of the connection. Furthermore, compared with previously known arrangements it is very space-saving and also allows the connection of hydraulic lines to the (piston) part of the lift cylinder, which for this purpose has a connection block 27 with hydraulic connections 28 on the supporting head. On the outside of its recess or the cylindrical wall section between the two locking notches the drawbar 14 has a recess 29 which corresponds to the size of the connection block 27, which projects from it. It is also possible to provide not just one, but two opposite recesses 29, whereby connection of the hydraulic hoses is possible from the coal face side as well as the packing side.

The foregoing description is, at present, considered to be the preferred embodiments of the present invention. However, it is contemplated that various changes and modifications apparent to those skilled in the art, may be made without departing from the present invention. Therefore, the foregoing description is intended to cover all such changes and modifications encompassed within the spirit and scope of the present invention, including all equivalent aspects.

We claim:

1. A lift cylinder assembly for a hydraulic support frame for underground mining comprising a lift cylinder, arranged essentially upright relative to the base shoes of the support frame, for lifting the base shoes during advancing, the lift cylinder being supported on one side by a return rod extending between the support frame and a face conveyor and on the other side by a drawbar which is connected to the base shoes, whereby the lift cylinder is attached in a limited pivoting manner to the drawbar with an end supporting head, wherein the supporting head is attached to the drawbar by use of a plug-type locking system comprising two plug-type locking elements, which include first locking notches on the drawbar essentially arranged laterally to the longitudinal axis of the lift cylinder, and, arranged essentially complementarily thereto second locking notches on the supporting head, whereby the plug-type locking elements engage in the first locking notches and/or the second locking notches with clearance.

2. The lift cylinder assembly according to claim 1, wherein the two plug-type locking elements are formed by the arms of an approximately U-shaped locking clamp.

3. The lift cylinder assembly according to claim 1, wherein the drawbar has a concave recess open towards the bottom which becomes a cylindrical wall section, and in that the first locking notches are arranged in the area of the cylindrical wall section.

4. The lift cylinder assembly according to claim 3, wherein the supporting head has a support surface corresponding to the shape of the concave recess and wherein the support surface has a cylindrical section in which the second locking notches are arranged.

5. The lift cylinder assembly according to claim 1, wherein the first locking notches and/or the second locking notches are approximately semi-circular in cross-section.

6. The lift cylinder assembly according to claim 1, wherein the first and/or the second locking notches are larger in cross-section than the plug-type locking elements.

7. The lift cylinder assembly according to claim 1, wherein the first locking notches are formed of transverse drilled holes passing through the drawbar and open laterally in the area of the recess or the cylindrical wall section.

8. The lift cylinder assembly according to claim 1, wherein the second locking notches are arranged tangentially to the supporting head and in parallel to each other.

9. The lift cylinder assembly according to claim 1, wherein the second locking notches are formed of an annular groove surrounding the supporting head.

10. The lift cylinder assembly according to claim 1, wherein the drawbar has at least one recess between the two first locking notches, which corresponding in size and shape to hydraulic connections provided on the lift cylinder or its supporting head.

11. The lift cylinder assembly according to claim 1, wherein the plug-type locking elements, when inserted, are secured with retaining elements.

12. The lift cylinder assembly according to claim 1 wherein the drawbar is approximately U-shaped.

13. A lift cylinder assembly adapted for use with an advancing support frame used in underground mining, the support frame including a base member, a movable drawbar and at least one shoe engaged with the drawbar, the lift cylinder assembly comprising:

a lift cylinder, the cylinder supported on the base member and extending vertically upward therefrom, the lift cylinder including a piston rod selectively extendable with respect to the cylinder, the distal end of the rod defining a supporting head, wherein the drawbar defines an underside surface which includes a recessed region in which the distal end of the rod engages upon extending the piston rod, the piston rod and the drawbar further defining, when the rod is extended and engaged with the recessed region of the drawbar and thereby defining an engagement interface, an aperture extending at right angles with a longitudinal axis of the rod, the aperture extending and intersecting the engagement interface; and a plug type locking element disposed in the aperture defined in the rod and the drawbar, whereby the rod is coupled to the drawbar.

14. The lift cylinder assembly in accordance with claim 13 wherein the aperture is defined by a first notch having a semi-circular profile defined in the recessed region of the drawbar and a second notch having a semi-circular profile defined in the rod.

15. The lift cylinder of claim 14 wherein the radius of the second notch is greater than the radius of the first notch.

16. The lift cylinder of claim 13 wherein the locking element is retained in the aperture by a retaining element.

17. The lift cylinder of claim 13 wherein the piston rod and the drawbar further define a second aperture extending at right angles with a longitudinal axis of the rod, the second aperture extending and intersecting the engagement interface.

18. The lift cylinder of claim 17 further comprising:

a second plug type locking element disposed in the second aperture defined in the rod and the drawbar.

19. The lift cylinder of claim 18 wherein a U-shaped locking clamp provides the two plug type locking elements.

* * * * *